United States Patent [19]

Flaherty

[11] Patent Number: 4,838,768

[45] Date of Patent: Jun. 13, 1989

[54] CONVERTIBLE PUMP SYSTEM

[76] Inventor: William J. Flaherty, 2536 East St., Davenport, Iowa 52803

[21] Appl. No.: 176,514

[22] Filed: Apr. 1, 1988

Related U.S. Application Data

[63] Continuation-in-part of Ser. No. 108,606, Oct. 15, 1987, abandoned.

[51] Int. Cl.[4] ..... F04B 49/00; F04B 19/00; B08B 3/00

[52] U.S. Cl. ..... 417/308; 417/314; 417/428; 417/440; 417/442; 134/167 C; 15/104.061

[58] Field of Search ..... 417/307, 308, 314, 238, 417/298, 427, 428, 440, 442; 15/104.33, 104.061; 134/166 C, 167 C, 169 C

[56] References Cited

U.S. PATENT DOCUMENTS

| | | | |
|---|---|---|---|
| 71,287 | 11/1867 | Dennison et al. | 417/427 |
| 313,879 | 3/1885 | Nagle | 417/440 |
| 867,932 | 10/1907 | Weeks | 417/427 |
| 1,061,511 | 5/1913 | Webb | 417/428 X |
| 1,176,518 | 3/1916 | Burns | 134/167 C |
| 1,481,358 | 1/1924 | Dwyer | 417/440 |
| 1,566,620 | 12/1925 | Scoville, Jr. | 417/440 |
| 2,566,702 | 9/1951 | Harrigan | 417/308 |
| 3,463,397 | 8/1969 | Mecklin et al. | 417/308 X |
| 3,601,452 | 8/1971 | Brunner | 417/298 X |
| 3,653,783 | 4/1972 | Sauder | 417/298 |
| 4,161,956 | 7/1979 | Hadgkiss | 15/104.33 |

*Primary Examiner*—Paul F. Neils

*Attorney, Agent, or Firm*—Henderson & Sturm

[57] ABSTRACT

A fluid pump system whose output can be varied by converting it from maximum output to a lesser output and in between by dumping or varying one of its pumping elements or pistons to the inlet side of the pump. More specifically, a pump is provided with two opposed pistons, both of which are connected to inlet and outlet for maximum capacity. The piston chamber of one piston is equipped with a converter line for leading that chamber back to the inlet, whereby only the remaining piston furnishes the pump discharge. Variations in the adjustable mode of the valve is reflected in the action of the pump relief valve to cause increased effectiveness of a jetter line supplied by the pump output.

6 Claims, 2 Drawing Sheets

Fig. 1
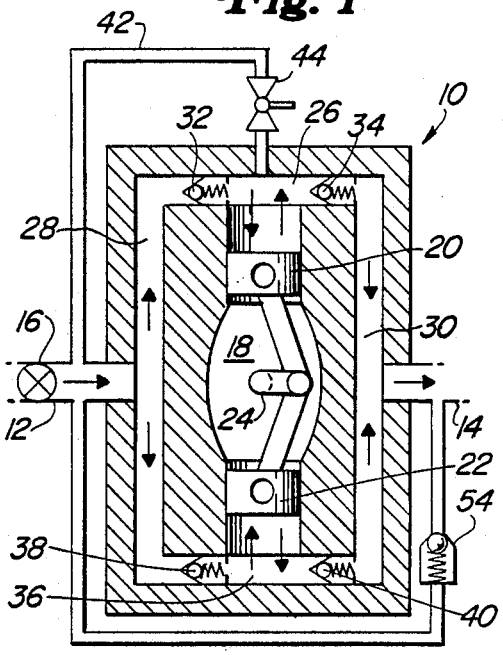
Fig. 2
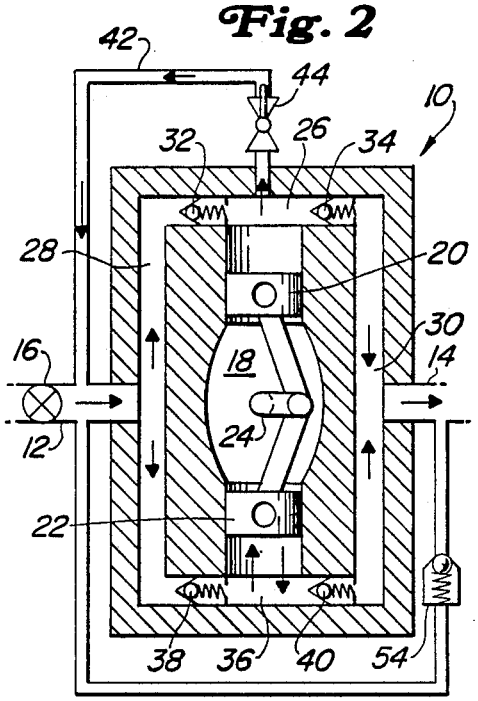
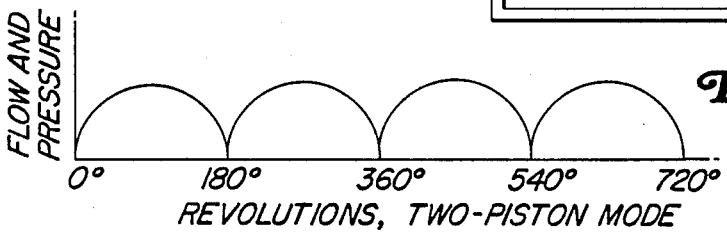
Fig. 3
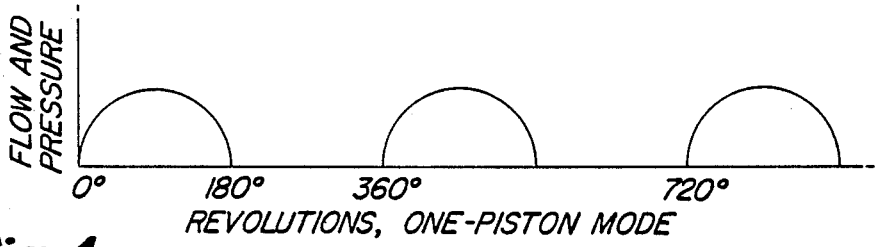
Fig. 4
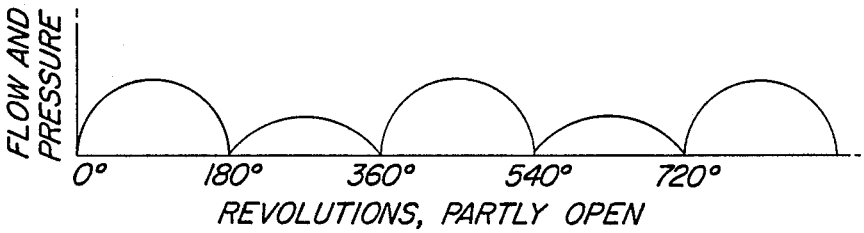
Fig. 5

CONVERTIBLE PUMP SYSTEM

This application is a continuation-in-part of co-pending application Ser. No. 108,606, filed Oct. 15, 1987, now abandoned.

BACKGROUND AND SUMMARY OF THE INVENTION

A pump system according to the present invention finds significant utility as a fluid pressure source for directing fluid under pressure through a "jetting" line; e.g., a hose or equivalent flexible conduit operative to clear blockages in fluid-conducting lines of the types commonly found in industrial environments; e.g., sewage lines, water lines, grease lines and the like. A typical jetter line has an outlet nozzle designed to pressurize the blockage while using part of the fluid pressure to advance the jetting line as the blockage deteriorates. Because lines requiring blockage removal are often sinous in parts, it is found that variations in fluid output or pulses from the pump pressurizing the jetting line is extremely helpful in causing the jetting line to accommodate all but the sharpest bends and curves. Accordingly, it is a principal object of the invention to provide a convertible pump system; that is, a pump system whose output is adjustably convertible between maximum output and a lesser output, and to achieve the conversion by simple and expedient means so that the pump is under control of the user at all times. A feature is the adaptability of the conversion system to existing pumps, thus effecting cost savings in manufacture, use and maintenance.

Further features, objects and advantages will appear as a preferred embodiment of the invention is developed in the ensuing description and accompanying drawings.

DESCRIPTION OF THE DRAWINGS

FIG. 1 is a sectional view of a representative pump in maximum output mode.

FIG. 2 is a similar view showing the pump in reduced output mode.

FIG. 3 is a graphic illustration of the output vs. revolutions characteristic of the FIG. 1 system.

FIG. 4 is a similar illustration as respects the FIG. 2 system.

FIG. 5 is a similar illustration showing the results when the relief valve pulsates in response to a part-open, part-closed condition of the control valve.

DETAILED DESCRIPTION OF A PREFERRED EMBODIMENT OF THE INVENTION

Figure 6:
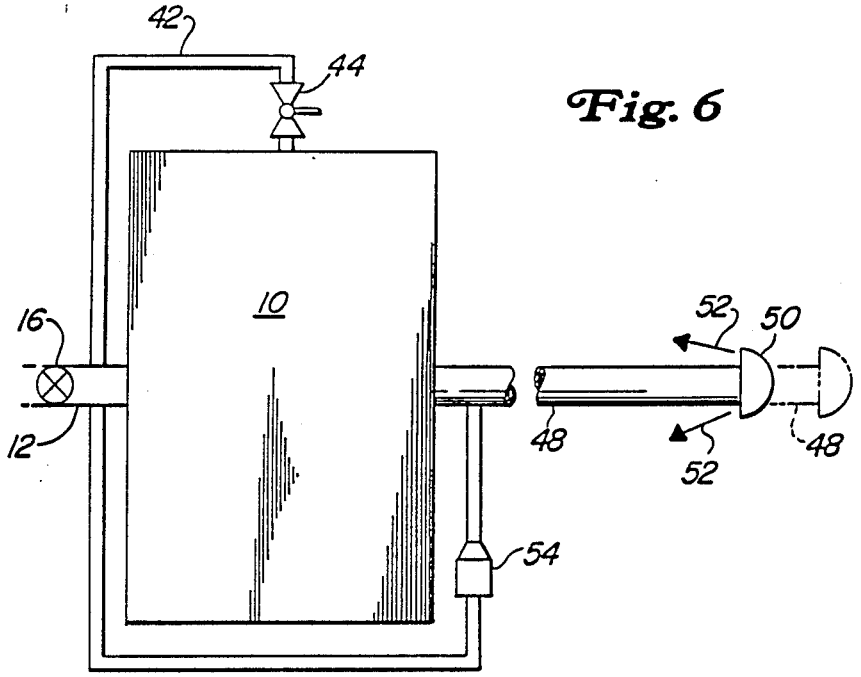
FIG. 6 is a reduced-scale view showing a typical jetter line connected to the pump output.

FIGS. 1 and 2 illustrate the pump relatively simply and thus omit refinements that could obviously be included in commercial versions. Basically, the pump comprising a casing or housing (10) having an inlet side (12) and an outlet or discharge side (14). In the jetting environment for which the pump is especially adapted, the inlet is designed for connection to a source of water (not shown), preferably heated, at typical city water pressure. A valve (16) is disposed in the inlet for manual control. The pump housing is formed interiorly with a crankcase (18) which contains driving means for a plurality of pumping elements, here a pair of pistons (20) and (22) diametrically opposed at opposite sides of the axis of a crankshaft (24), here representative of the driving means which may be powered by any suitable source, such as an electric motor, internal-combustion engine, etc. (not shown).

The upper piston operates in conjunction with a chamber (26) which branches at (28) and (30), respectively, to the inlet and outlet (12) and (14). Typical check valves (32) and (34) control the entrance and discharge of fluid to and from the chamber as the piston reciprocates, the valve (32) opening to admit fluid while the valve (34) is closed and vice versa. The lower piston operates with a lower chamber (36) which has inlet and outlet check valves (38) and (40) respectively associated with the branches (28) and (30).

From the description thus far, and without more, the pump is a multi-piston (two) type with the pistons taking in from the inlet (12) via (28) and discharging through the branch (30) and outlet (14) as the pistons reciprocate and the check valves (32), (34), (38) and (40) alternately open and close, thus furnishing maximum pulsing output to whatever line is connected to the outlet or high-pressure side (14) of the pump.

In order to reduce the output of the pump, as by converting it from a two-piston pump to a one-piston pump, a converter means is provided, here in the form of a converter or dump line or passage (42) that leads from the upper piston chamber (26) to the inlet side of the pump and controlled manually by a suitable adjustable or variable valve (44). When the valve (44) is closed, the dump line is of course blocked and two-piston operation results. When the valve (44) is opened, the dump line is also open and any fluid taken into the chamber (26) by the piston (20) through the intake check valve (32) is pumped out or dumped to the line (42) and not out through the check valve (34) to the pressure or outlet branch (30). As best seen in FIGS. 3 and 4, the pump delivers (pulses) on every half revolution as a two-piston pump (FIG. 3) and on only every other half-revolution as a one-piston pump (FIG. 4).

FIG. 6 shows schematically the association of the output of the pump with a jetter line (48) which has at its terminal or remote end a jetter head (50) of typical design operative to jet fluid rearwardly (arrows 52) so as to advance the line in order to enable it to clear blocked passages, etc. Adjustment of the valve (44) between its open and closed positions creates the results depicted in FIGS. 3 and 4, respectively. Intermediate results, for example as shown in FIG. 5, occur according to whether and to what extent a relief valve (54) opens and closes, which develops pulsating flow characteristics in the jetter line, which, being stretchable within limits, advances. The operator can observe the jetter line as to vibration and can control the metering effect of the valve (44), causing the relief valve (54) to "hammer" between open and closed positions. For example, assuming a pump delivery of 2.25 GPM at 1000 psi and a jet head flow of 1.75 GPM at 1000 psi: when the valve (44) is closed, a flow of 0.50 GPM will keep the relief valve open. When the valve (44) is metered upon for an estimated flow of 0.40 GPM, the excess of 0.10 GPM has to flow through the relief valve. This small flow rate causes the relief valve to hammer and thus the jetter hose to vibrate, increasing its "activity" so far as concerns its jetting function.

The variable and on-off feature via the valve (44) is important in breaking up various kinds of blockages. For example, in a frozen water line, with limited hot water available, operation at reduced capacity reduces water consumption and thus prolongs the length of time that the water will stay in the hot-to-warm range. Also, the spaced intervals or pulses in the one-piston mode enable manual manipulation of the jetting line or hose for easier travel through bends, curves, etc. The simple construction makes for a light-weight design, leading to economy and portability, especially when the unit must be carried up and down stairs, ladders, etc.

Features and advantages not specifically pointed out here will occur to those versed in the art, as will many modifications in the preferred embodiment disclosed, all without departure from the spirit and scope of the invention.

I claim:

1. A pulsating fluid jet system, comprising: a pump having a fluid inlet, a fluid outlet, first and second fluid chambers, first and second fluid intake lines connecting the first and second chambers respectively to the inlet, first and second discharge lines connecting the first and second chambers respectively to the outlet, first and second pumping elements associated respectively with the first and second chambers, means in the casing for driving the elements in alternating relation so that one element operates in a fluid intake phase while the other element operates in a fluid discharge phase, first and second intake check valve means respectively in the first and second intake lines, first and second fluid discharge check valve means respectively in the first and second discharge lines, a relief valve connected to the outlet and leading to the inlet, a flexible jetter line connected to the outlet, and a selectively variable valve means for selectively effectuating and negativing the discharge phase of one pumping element exclusively of the other pumping element for enabling selective operation of the pump in either a one-element mode or a two-element mode, said variable valve means being selectively adjustable to meter fluid flow in said discharge phase for causing vibratory opening and closing of the relief valve and thus to agitate the jetter line.

2. The system according to claim 1, in which the pumping elements are pistons.

3. The system according to claim 2, in which the driving means is rotary and the pistons are diametrically opposed as respects the axis of the rotary means.

4. The system according to claim 1, in which the variable valve means includes a converter fluid line connected to one chamber intermediate its associated check valves and leading to the inlet and a manual valve selectively operative among open and closed positions and intermediate positions in the converter line for effecting operation of the pump in a one-element mode when the valve is open, and in a two-element mode while the valve is closed and in an intermediate mode when the valve is in an intermediate position.

5. The convertible pump according to claim 4, in which the converter line includes a portion disposed externally of the casing.

6. The convertible pump according to claim 5, in which the manual valve is disposed in the external portion of the converter line.

* * * * *